US009440814B1

(12) United States Patent
Lefevre et al.

(10) Patent No.: US 9,440,814 B1
(45) Date of Patent: Sep. 13, 2016

(54) METHOD AND APPARATUS FOR MITIGATING SHEET WRINKLE RESULTING FROM DECURLER CONTAMINATION

(71) Applicant: XEROX CORPORATION, Norwalk, CT (US)

(72) Inventors: Jason M Lefevre, Penfield, NY (US); Michael J Levy, Webster, NY (US); David A Vankouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/969,009

(22) Filed: Dec. 15, 2015

(51) Int. Cl.
*B65H 29/70* (2006.01)
*B41J 3/60* (2006.01)
*G03G 15/00* (2006.01)

(52) U.S. Cl.
CPC ..... *B65H 29/70* (2013.01); *B41J 3/60* (2013.01); *G03G 15/6576* (2013.01)

(58) Field of Classification Search
CPC . B65H 29/70; G03G 15/6576; B41J 11/0005
See application file for complete search history.

(56) References Cited

U.S. PATENT DOCUMENTS

| | | | | | |
|---|---|---|---|---|---|
| 5,394,251 | A * | 2/1995 | Aikens | G03G 15/55 | 358/405 |
| 5,515,152 | A | 5/1996 | Kuo | | |
| 5,771,054 | A * | 6/1998 | Dudek | B41J 2/01 | 346/138 |
| 5,848,347 | A * | 12/1998 | Kuo | B65H 29/12 | 162/271 |
| 6,282,403 | B1 * | 8/2001 | Spencer | B65H 20/02 | 100/47 |
| 2009/0257801 | A1 * | 10/2009 | Miyoshi | B65H 37/00 | 399/406 |

FOREIGN PATENT DOCUMENTS

JP 2010168177 A * 8/2010

* cited by examiner

*Primary Examiner* — Daniel J Colilla

(57) ABSTRACT

A decurler method and apparatus that compensates for ink contamination buildup on an indent roll of a decurler in aqueous ink jet products that can lead to paper wrinkle. A gap between the centers of the indent roll and a soft roll is increased to prevent sheet wrinkle by employing an algorithm that determines when the rolls are in contact and are first matching speed with each other and then treats this position as a home position.

14 Claims, 3 Drawing Sheets

METHOD AND APPARATUS FOR MITIGATING SHEET WRINKLE RESULTING FROM DECURLER CONTAMINATION

The device and method disclosed in this document relates to inkjet printers that eject aqueous ink directly onto media and, more particularly, to a decurler apparatus and method for use with such inkjet printers.

In general, inkjet printing machines or printers include at least one printhead that ejects drops or jets of liquid ink onto a recording or image forming surface. In some inkjet printers, the printhead ejects ink directly onto the surface of media as the media passes the printhead. The media can be in the form of a continuous web or in the form of sheets. In continuous web printers, the media is pulled from a supply roll by actuator-driven rollers. As the web moves through the printer it passes around rollers to which tension is applied to keep the web taut as it passes through the printer to a take-up roll. In sheet printers, actuator-driven rollers are positioned against one another to form nips and these nips urge the sheets through the printer.

In inkjet printers that eject ink directly onto sheets, media deformation occurs more frequently in sheet printers than continuous web printers since a web is generally taut as it passes through the printer. Sheets having leading and trailing edges that can get caught in structure and wrinkled. Additionally, the sheets can absorb moisture in the inks ejected onto the sheets and this moisture can cause curling or other deformations in the media. These deformations are particularly troublesome in inkjet printers that employ water-based or solvent-based inks in which pigments or other colorants are suspended or in solution. The water and solvents in the inks can change the physical properties of the sheets in ways that degrade the quality of the images produced on the media sheets. In these aqueous ink printers, an unacceptable level of down-curl can be induced on the printed sheet by the image (particularly when a solid stripe of ink is printed on the Lead-Edge of a sheet).

Consequently, an upstream decurler is used to generate up-curl, which can be used to counter-act the down-curl that is induced by the printed image in an aqueous ink-jet marking engine. This function is an important feature of the machine, particularly when the printed sheet is delivered to an in-line stacker, which has an input specification limit for curl.

The upstream decurler in an output module of a printing machine is used for reducing the amount of down-curl in the sheets prior to delivering the sheets to the stacker.

It has been found that an indenting shaft of an upstream decurler in printing machines will develop ink buildup when operating under some stress paper and ink loading conditions. If Ink buildup on the indenting shaft persists it will eventually cause sheet wrinkle in the decurler, which is not acceptable to the customer and could result in the customer calling a customer service engineer in for a service call depending on the severity of the ink buildup.

A decurler that changes away from image to toward image direction in sheets is shown in U.S. Pat. No. 5,515,152 issued to Youti Kou. The decurler uses tandem gates and bending baffles to direct copy papers to different decurling paths to reduce copy curl. A controller automatically determines the optimum decurling path for an individual copy paper according to sender inputs derived from the paper basis weight, color layers, image area converge and relative humidity.

Obviously, in view of the prior art, there is still a need for mitigating sheet wrinkle resulting from decurler contamination.

BRIEF SUMMARY

In answer thereto, provided hereinafter is a method and apparatus employed in an indent decurler to compensate for ink contamination buildup on the indent roller in aqueous ink jet products that can lead to paper wrinkle. A gap between centers of a decurler hard shaft or roller and soft conformable roller is increased by employing an algorithm that determines when the rollers are in contact and are first matching speed with each other and then treats this position as a home position. The determination of when to run this algorithm can be manual, for example, by noticing sheet wrinkle or by automated wrinkle detection methods.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some components are known per se' in other apparatus or applications, which may be additionally or alternatively used herein, including those from art cited herein. The cited references, and their references, are incorporated by reference herein where appropriate for teachings of additional or alternative details, features, and/or technical background. What is well known to those skilled in the art need not be described herein

BRIEF DESCRIPTION OF THE DRAWINGS

The foregoing aspects and other features of an apparatus or printer that compensates for media wrinkle caused by contamination build-up on an upstream decurler shaft are explained in the following description, taken in connection with the accompanying drawings.

Figure 1:
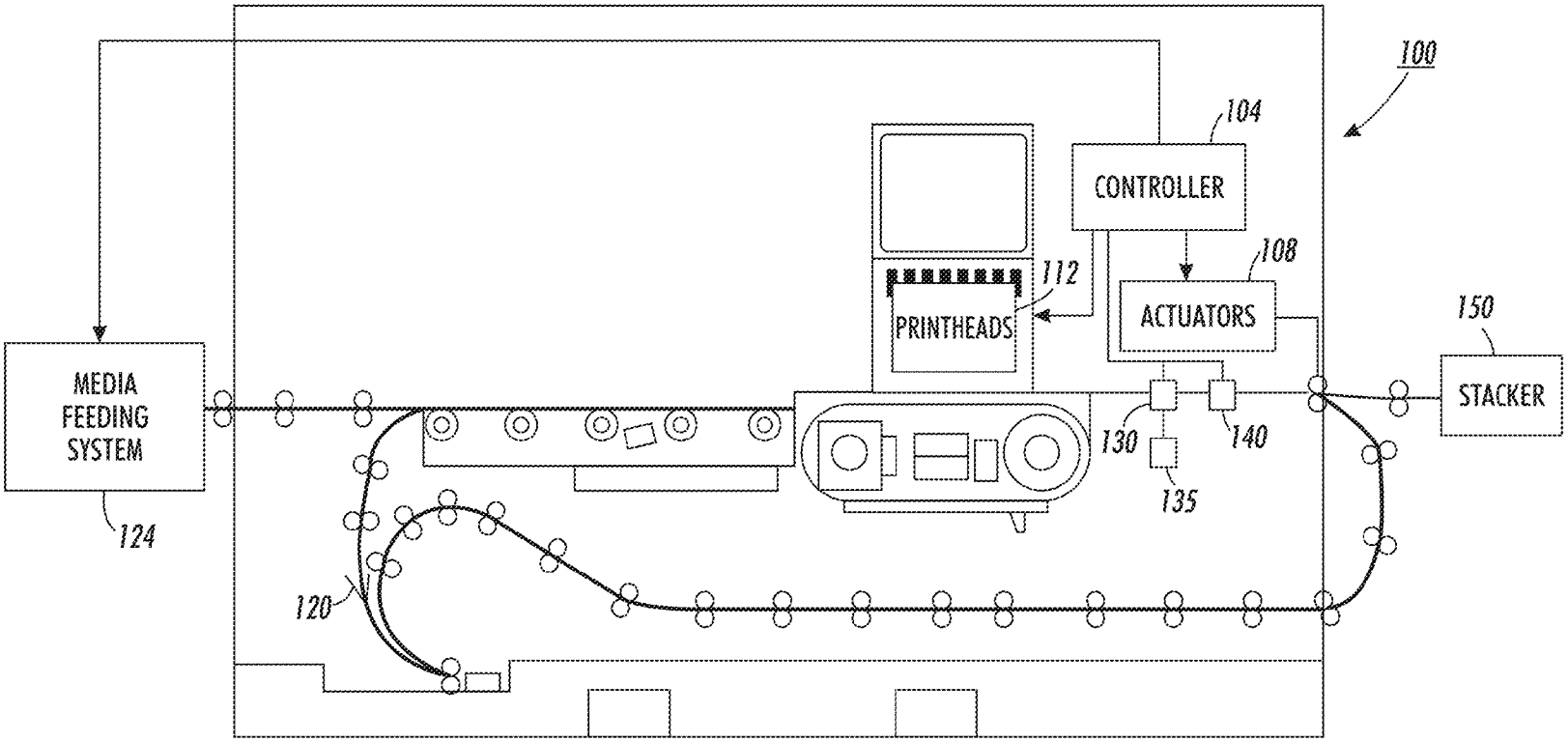
FIG. 1 is diagram of an inkjet printer that compensates for media wrinkle prior to the media reaching a stacker apparatus.

For a general understanding of the environment for the device disclosed herein as well as the details for the device, reference is made to the drawings. In the drawings, like reference numerals designate like elements. As used herein, the terms "printer," "printing device," or "imaging device" generally refer to a device that produces an image on print media with liquid ink and may encompass any such apparatus, such as a digital copier, bookmaking machine, facsimile machine, multi-function machine, or the like, which generates printed images for any purpose. Image data generally include information in electronic form that a controller renders and uses to operate the inkjet ejectors in printheads to form an ink image on media sheets. These data can include text, graphics, pictures, and the like. The operation of producing images with colorants on print media, for example, graphics, text, photographs, and the like, is generally referred to herein as printing or marking. Aqueous inkjet printers are printers that use inks having a high percentage of water relative to the amount of colorant and/or solvent in the ink.

The term "printhead" as used herein refers to a component in the printer that is configured with inkjet ejectors to eject water-containing drops or ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

FIG. 1 shows a configuration of an inkjet printer 100 that includes a controller 104, one or more actuators 108, a printhead assembly 112, a transport subsystem 120 and a media feeding subsystem 124. The controller is operatively connected to the actuators 108, the printhead assembly 112, and the media feeding subsystem 124. The controller 104 is configured to receive image data from an image data source and generate firing signals for the operation of the printheads in the printhead assembly 120 for the formation of ink images on media sheets as the sheets pass by the printheads. The media sheets are stored in the media feeding subsystem 124 and the controller operates the media feeding subsystem to retrieve media sheets from the storage receptacle for the sheets and feed the sheets into the transport subsystem 120. The controller operates the actuators 108 to drive rollers within the transport system 120 to move the media sheets along a path in the transport subsystem that passes the sheets past printhead assembly 112. The sheets pass an up-curl decurler 130 that is connected to sensor 135 which signals the speed of rollers within decurler 130 to controller 104. The sheets are then conveyed past down-curl decurler 140 and either ejected from the transport subsystem into a conventional stacker 150 for retrieval or they are diverted to the lower path of the transport subsystem. The lower path is configured for flipping the sheets over so the unprinted side of the sheets can be returned to the path past the printhead assembly 112 before being directed into stacker 150 for retrieval.

To operate the inkjet ejectors in the printheads of the printhead assembly 112, the controller 104 receives a file of image data of an image to be produced on the media sheet. This image can include text alone, graphics alone, or a combination of text and graphics. These image data can be provided by a scanner or by an application program in a known manner. The controller 104 generates color separations and renders the color separations to produce halftone data. These halftone data can be provided to a processor in the printhead assembly 112 for the generation of firing signals or the controller can generate the firing signals and download them to a printhead controller in the assembly 112. The printhead assembly then operates the inkjet ejectors in the printheads of the printhead assembly 112 to eject ink drops onto the media sheet as the sheet passes the printheads to form an ink image on the sheet. Additionally, the controller 104 generates signals to operate one or more of the actuators 108 to coordinate the movement of media sheets and the operation of the inkjet ejectors in the printheads of the printhead assembly 112.

Figure 2:
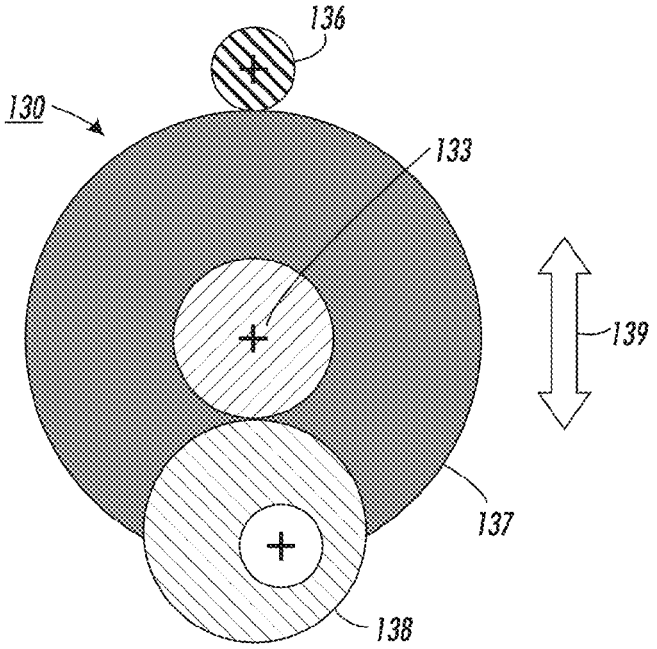
FIGS. 2 and 3 are partial, frontal views of up-curl apparatus in FIG. 1.
Figure 3:
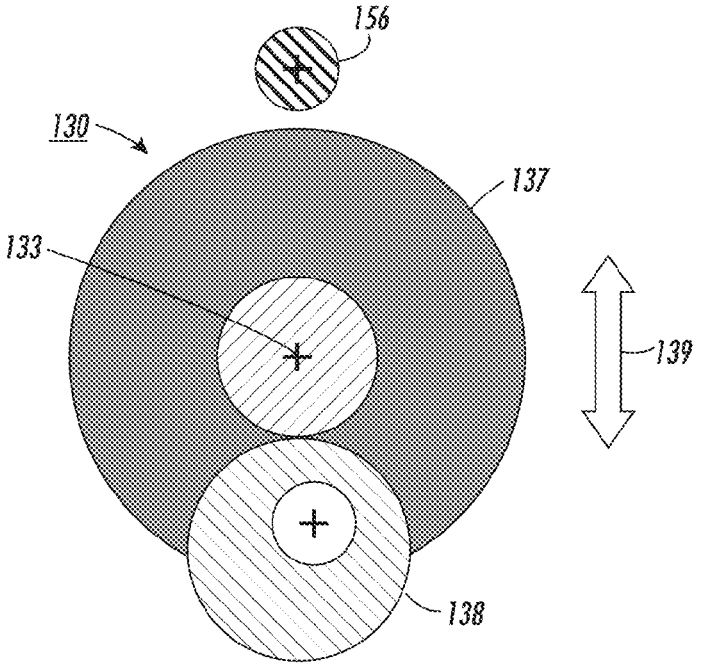

In accordance with the present disclosure, up-curl decurler 130 in FIG. 1 is adapted to reduce the amount of down-curl present in sheets (particularly when a solid stripe of ink is printed on the lead edges of the sheets) prior to delivering them to stacker 150. This is critical because contamination due to ink build up in the up-curl decurler will occur when operating in some stress paper and ink conditions and thereby cause sheets to wrinkle. Up-curl decurler 130 as shown in FIGS. 2 and 3 addresses this issue by employing an indenting hard shaft or roller 136 that mates with a soft and conformable shaft or roller 137. Soft roller 137 is shiftable by cam 138 that contacts a steel core 133 of soft roller 137 which protrudes past where the conformable covering 137 ends and is moved by a conventional stepper motor (not shown) into and out of engagement in the directions shown by arrow 139 on a signal from controller 104 that is connected to sensor 135. Indenting shaft 136 is used to generate up-curl, which can be used to counter-act the down-curl that is induced by the printed image in an Aqueous Ink-Jet marking engine.

As shown in FIGS. 2 and 3, up-curl decurler 130 employs a "Home" finding sequence and algorithm that will allow a nip formed between hard roller 136 and soft roller 137 to open up slightly when ink buildup is encountered, which then will eliminate sheet wrinkling as a result of the excessive and/or non-uniform nip indentation when ink buildup occurs. A "long" homing sequence in accordance with the present disclosure is an improvement over the standard homing sequence where decurler indentation goes directly to a known pre-determined indentation only when it is needed because of a wrinkle occurrence.

In practice, when sheet wrinkling due to decurler contamination is experienced, printer 100 will cycle-out while hard roller 136 and soft roller 137 are in a mating position as shown in FIG. 2. Upon the next printer cycle-up, decurler 130 will go through a "long" home finding sequence. In the "long" home finding sequence, the decurler indenting shaft 136 and the conformable roller 137 are initially dis-engaged from one another as shown in FIG. 3. When the printer cycles-up, the indenting (driven) shaft 136 begins to turn, and when the indenting shaft has reached full speed, cam 138 begins to move conformable (idler) roller 137 towards indenting roll 136. When controller 104 in response to signals from speed sensor 135 determines that the two have made contact and are moving the same surface speed, then the "Home" position for indentation is determined. At this point, media feeder system 124 can start introducing sheets into the printer. By using the "long" homing sequence when ink buildup is experienced, the ultimate center-to-center distance between the indenting shaft 136 and the conformable roller 137 will be slightly greater than it was previously, thus compensating for the small artificial increase in the decurler shaft diameter due to ink buildup. Wrinkle is mitigated in this manner, because the small (many times non-uniform) artificial increase in the indenting shaft diameter has been compensated for in the new shaft center-to-center distance. As a result, a higher range of ink coverage across many (particularly ink-jet treated) medias is accommodated, thus enabling previously unachievable media latitude.

Figure 4:
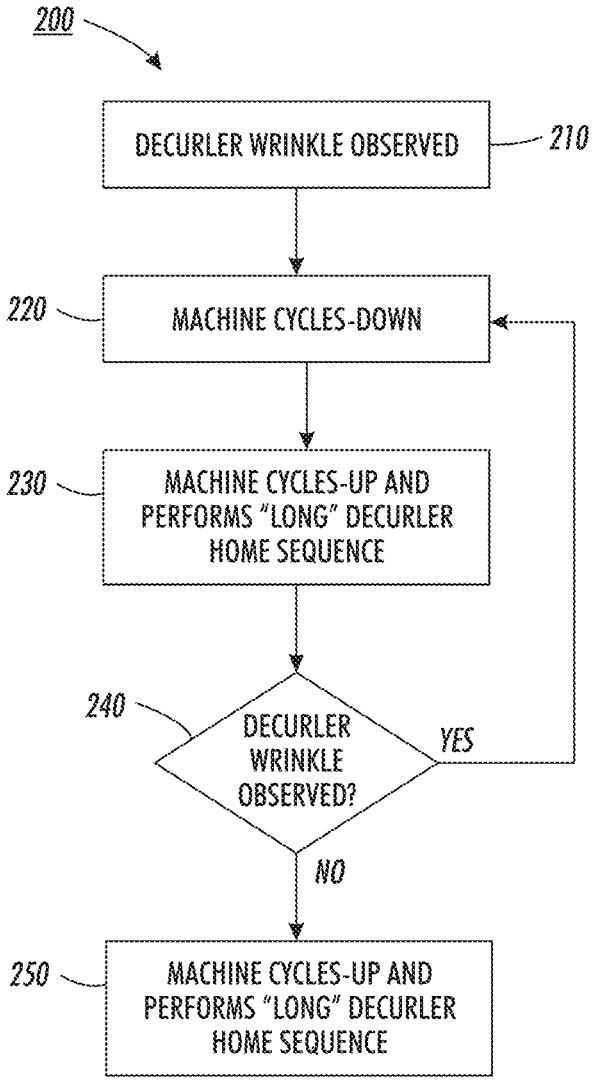
FIG. 4 is a flow diagram of a wrinkle mitigation sequence in accordance with the present disclosure.

A flow diagram 200 is shown in FIG. 4 that depicts the wrinkle mitigation sequence of the present disclosure where in block 210 decurler wrinkle is observed and the printer is stopped and cycles down in block 220. In block 230 the printer has been started again and cycles up and performs the "long" decurler home sequence. Afterwards, the sheets are observed for any indications of wrinkle in block 240 and if NO wrinkle is observed the job continues to run as scheduled as shown in block 240. However, if wrinkle is observation as called for in block 250, the printer is cycled down and will then go through at least the sequence of blocks 220 through 240 when cycled up again.

In recapitulation, a decurler "home" finding algorithm is disclosed that will allow the decurler nip to open up slightly when ink buildup is encountered, which then will eliminate sheet wrinkling as a result of the excessive and/or non-uniform nip indentation when ink buildup occurs. By using the "long" home finding sequence when ink buildup is experienced, the ultimate center-to-center distance between the indenting shaft and the conformable roll will be slightly greater than it was previously, thus compensating for the small artificial increase in the decurler shaft diameter due to ink buildup and thereby eliminating sheet wrinkle.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for mitigating media wrinkle resulting from decurler contamination in an aqueous ink printer which conveys media having a printing operation which can be cycled down by an operator, comprising:

providing a transport path configured to convey media through the printer in a process direction;

providing a printhead assembly configured with printheads to eject drops of aqueous ink onto media conveyed by the transport path past the printhead assembly in the process direction;

providing a decurler in said transport path downstream of said printhead assembly, said decurler including an indenting roller and a conformable roller positioned in a first contacting and home position for indentation while media is conveyed through said printer and a non-contacting position with respect to each other once said printer is cycled down;

cycling said printer UP to feed said media from a stack;

cycling said printer down in response to observing contamination on said indenting roller causing wrinkle in media exiting said printer;

cycling said printer up to resume feeding said media from said stack resulting in said indenting roller and said conformable roller being positioned in a second contacting position;

providing a cam and initiating movement of said conformable roller toward said indenting roller with said cam to position said indenting roller and conformable roller into said second contacting position;

providing a speed sensor connected to said decurler and adapted to send signals indicating said conformable roller and said indenting roller are in said second contacting position and are both moving at the same speed; and providing a controller adapted to receive said signals from said speed sensor and in response thereto establish said second contacting position as a second home position for indentation of said indenting roller and conformable roller wherein a thickness of said contamination on said indenting roller separates said indenting roller from said conformable roller in said second home position.

2. The method of claim 1, including activating said controller to reposition said indenting roller with respect to said conformable roller in response to build-up of said contamination on said indenting roller to create a space between outer surfaces of said indenting roller and said conformable roller equal to said thickness of said contamination on said indenting roller.

3. The method of claim 2, wherein a center-to-center distance between said indenting roller and said conformable roller is greater in said second contacting position than in said first contacting position.

4. The method of claim 2, wherein a space separating rotational axes of said indenting roller and said conformable roller is greater in said second contacting position than in said first contacting position.

5. The method of claim 4, wherein said contamination on said indenting roller is due to ink build-up on said indenting roller.

6. The method of claim 4, wherein said printer is a full width, water based aqueous ink jet machine.

7. A full width, water based aqueous ink jet printer, comprising:

a transport path configured to convey media through the printer in a process direction;

a printhead assembly positioned opposite said transport path, the printhead assembly being configured with printheads to eject drops of aqueous ink onto said media conveyed by said transport path past said printhead assembly in said process direction;

a controller operatively connected to said printheads of said printhead assembly, the controller being configured to operate the printheads of said printhead assembly to eject aqueous ink onto said media to form an ink image that corresponds to image data received by said controller;

a decurler connected to said controller and including an indenting roller and a conformable roller with said indenting roller having contamination on an outer surface thereof due to said media being conveyed through said printer in contact therewith; and wherein said controller is adapted to open UP said conforming roller with respect to said indenting roller in response to said contamination on said outer surface of said indenting roller an amount equal to a thickness of said contamination.

8. The full width, water based aqueous ink jet printer of claim 7, wherein said indenting roller forms a nip with said conformable roller and said decurler includes a sensor adapted to send signals to said controller.

9. The full width, water based aqueous ink jet printer of claim 8, wherein said controller uses signals from said sensor to initiate feeding of media from a media feeding system.

10. The full width, water based aqueous ink jet printer of claim 8, including a cam configured to move said conformable roller into and out of engagement with said indenting roller.

11. The full width, water based aqueous ink jet printer of claim 10, wherein said conformable roller includes a shaft and said cam is rotated against said shaft to manipulate said conformable roller.

12. A decurler adapted to remove wrinkle from sheets, comprising:

an indenting shaft;

a conformable roller, said conformable roller forming a sheet feeding nip with said indenting roller as a first nip position and mounted on a support shaft with at least one end of said shaft being exposed;

a cam positioned in contact with said at least one exposed end of said support shaft and adapted to move said conformable roller toward and away from said indenting shaft;

a sensor adapted to sense rotation speed of said indenting shaft and said conformable roller when brought into contact by said cam and send signals when said indenting shaft and said conformable roller are rotating at the same speed; and a controller adapted to receive said signals from said sensor and in response thereto control movement of said conformable roller away from said indenting shaft a predetermined amount into a second sheet feeding nip position creating a space between an outer surface of said indenting shaft and an outer surface of said conformable roller equal to ink build-up on said indenting shaft.

13. The decurler of claim 12, wherein said decurler is positioned within a full width, water based aqueous ink jet printer.

14. The decurler of claim 12, wherein said cam increases center-to-center distance between said indenting shaft and said conformable roller to open up said conformable roller from said indenting shaft from said first sheet feeding nip position to said second sheet feeding nip position.

* * * * *